US012196466B1

(12) United States Patent
Slager et al.

(10) Patent No.: US 12,196,466 B1
(45) Date of Patent: Jan. 14, 2025

(54) METHOD, SYSTEM AND DEVICE FOR CONVERTING A STANDARD MINI-SPLIT AC UNIT INTO A QUICK CONNECT MINI-SPLIT AC UNIT

(71) Applicant: Perfect Aire LLC, Countryside, IL (US)

(72) Inventors: Jason A. Slager, Lockport, IL (US); Michael Delwiche, Gregory, MI (US)

(73) Assignee: Perfect Aire LLC, Countryside, IL (US)

( * ) Notice: Subject to any disclaimer, the term of this patent is extended or adjusted under 35 U.S.C. 154(b) by 196 days.

(21) Appl. No.: 17/670,261

(22) Filed: Feb. 11, 2022

Related U.S. Application Data

(60) Provisional application No. 63/148,685, filed on Feb. 12, 2021.

(51) Int. Cl.

| | |
|---|---|
| ***F25B 45/00*** | (2006.01) |
| ***F25B 41/40*** | (2021.01) |
| ***F25B 49/00*** | (2006.01) |

(52) U.S. Cl.
CPC ..... *F25B 41/40* (2021.01); *F25B 49/005* (2013.01); *F25B 2700/04* (2013.01)

(58) Field of Classification Search
CPC ..... F25B 39/02; F25B 41/40; F25B 45/00; F25B 2339/02; F25B 2345/001; F25B 2500/18
See application file for complete search history.

(56) References Cited

U.S. PATENT DOCUMENTS

2020/0088417 A1* 3/2020 Ingram ..... F24F 13/32
2020/0370764 A1* 11/2020 Strickland ..... F24F 1/34

* cited by examiner

*Primary Examiner* — Jonathan Bradford
(74) *Attorney, Agent, or Firm* — Charles T. Riggs, Jr.

(57) ABSTRACT

A method, system and device provides for the conversion of a mini-split AC unit to a mini-split AC unit with quick connect pre-charged ends. Quick connect fittings are placed onto the AC unit lines after the nitrogen pre-charge is released from the liquid line. A fitting tool/device having one or more fittings and valves is attached to the liquid line. A vacuum pump attached to the fitting tool/device vacuums the evaporator until its micron level falls and stays below 500 microns. Then, a refrigerant line attached to the fitting tool/device adds approximately 1 ounce of refrigerant to the evaporator.

20 Claims, 24 Drawing Sheets

METHOD, SYSTEM AND DEVICE FOR CONVERTING A STANDARD MINI-SPLIT AC UNIT INTO A QUICK CONNECT MINI-SPLIT AC UNIT

TECHNICAL FIELD

The exemplary teachings herein pertain to methods, systems, components and/or devices for providing quick connect fittings on an air conditioning unit, and in particular, to methods, systems and devices for converting a standard mini-split air conditioner unit into a quick connect mini-split air conditioner unit.

BACKGROUND

Mini-split and multi-split air conditioning systems are typically ductless systems which supply conditioned cooled and/or heated air to one or more rooms of a house or building in a decentralized manner. The mini split system comprises an indoor unit and an outdoor unit connected by refrigerant lines and a communication cable. Multi-zone or multi-split systems are ductless systems allowing multiple rooms to be conditioned independently, each with its own indoor unit and simultaneously from a single outdoor unit. One problem with mini-split or multi-split systems is that the connections on the refrigerant lines connecting the external unit to the internal ones can leak if improperly installed.

Correct installation of a mini-split air conditioning (AC) heat pump system is the most important part of an AC system. Flares are prone to leaking no matter who is doing them or how well they were done. Some mini-split AC systems come with quick connect refrigerant line fittings (Quick Connect Mini-split AC Units), while others do not (Standard Mini-split AC Units). The quick connect practice ensures a near flawless install and speeds up the installation process as well as potentially prolonging the life of HVAC equipment.

Therefore, there is a need for method(s), system(s) and device(s) providing for the conversion of a standard mini-split air conditioner unit into a quick connect mini-split air conditioner unit. The method(s), system(s) and device(s) of the present disclosure fulfills this and other needs.

SUMMARY

Disclosed herein is one or more method(s), system(s) and device(s) for converting a standard mini-split AC system into a quick connect mini-split AC system. In one embodiment, the method and system is as follows:

On the AC system's evaporator, first release the nitrogen pre-charge that is in the evaporator from the factory by loosening and removing the plastic cap on the liquid line, then remove the plastic cap from the suction line.

Screw one "quick connect" fitting onto the suction line and one onto the liquid line, and tighten until it cannot be tightened anymore. Then, draw a line with a permanent marker that goes from the quick connect fitting to the flare fitting. If the lines are not lined up after installation, the quick connect fitting was loosened and needs to be retightened.

Screw the fitting tool/device to the quick connect fitting that is on the liquid line of the evaporator. The fitting tool/device is a series of pipe fittings that have valves and allows for the connection of a vacuum gauge and a vacuum pump to remove moisture. It will also allow for isolation of the system to perform a decay test for making sure there is no moisture in the system.

Connect a vacuum pump to one end of the fitting tool/device and the micron gauge to the other end of the fitting tool/device.

Begin the vacuum process. Vacuum the evaporator down to 200 microns (as a measure of moisture level) on the micron gauge that is connected to the fitting tool/device. This can take anywhere from approximately two to over five minutes depending on the humidity level of the atmosphere where the method is being performed.

After reaching 200 microns or lower, start the decay test. Allow at least several minutes, for example ten minutes, to make sure the micron level does not rise above 500 microns.

If the unit rises above 500 microns, then perform the vacuuming again back down to 200 microns then repeat the decay test.

If the unit does not rise above 500 microns, then remove the vacuum pump and proceed with adding of refrigerant.

Connect the refrigerant line, which has been purged from air and is full of refrigerant, to the fitting tool/device.

Isolate the micron gauge by removing from the tool/device or via a valve if provided so no refrigerant can/will damage it.

With the refrigerant tank on a scale or wireless scale, add 1 oz. of refrigerant to the evaporator by opening the valve on the end of the charging line. This small amount of refrigerant will add positive pressure to the evaporator. By doing this, when the connection from the line set is made to the evaporator it will aid in keeping air/moisture from entering the sealed system. This small amount of refrigerant should not have any effect on the operation of the system.

After the system has the refrigerant added, quickly remove the tool from the evaporator.

These are the main steps for turning a standard mini-split AC system into a quick connect mini-split AC system. The entire process can be competed in approximately ten minutes per unit.

Additional advantages and novel features will be set forth in part in the description which follows, and in part will become apparent to those skilled in the art upon examination of the following and the accompanying drawings or may be learned by production and/or operation of the teachings herein.

BRIEF DESCRIPTION OF THE DRAWINGS

The drawing figures depict one or more implementations in accordance with the present teachings, by way of example only, not by way of limitation. It should be understood that such drawings depict preferred embodiments of the invention and are not to be considered as being limiting in scope with regard to other embodiments which are capable of being contemplating from this disclosure. A clear understanding of the disclosed methods and systems may be had by reference to the appended drawings, wherein like reference numerals refer to the same or similar elements.

DETAILED DESCRIPTION

The following description refers to numerous specific details which are set forth by way of examples to provide a thorough understanding of the relevant method(s), system(s) and device(s) disclosed herein. It should be apparent to those skilled in the art that the present disclosure may be practiced without all of such details. In other instances, well known methods, procedures, components, instruments, implements and/or devices have been described at a relatively high-level, without detail, in order to avoid unnecessarily obscuring aspects of the present disclosure.

The method(s), systems(s) and device(s) of the present disclosure can be used to convert an existing pre-packaged AC unit, for example a 24,000 BTU mini-split AC unit, into a quick connect pre-charged AC unit, that can easily be repackaged, i.e., re-sealed in the original packaging, as if the modified AC unit was originally sent from the manufacturer.

Figure 1:
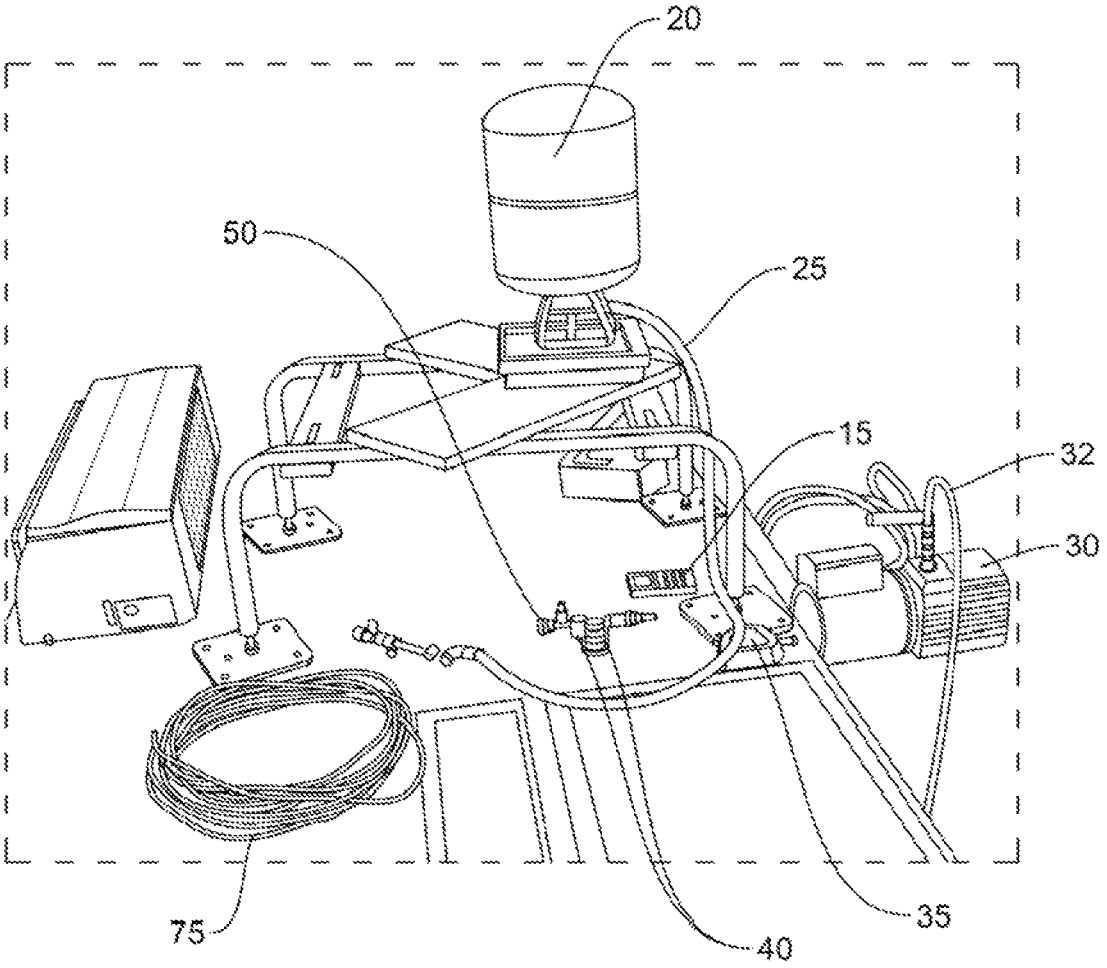
FIG. 1 is an illustration of the components of an embodiment of a system of the present disclosure.

FIG. 1 illustrates the equipment used in an embodiment of a method and system of the present disclosure. The system preferably comprises a digital scale 15 with an inverted refrigerant tank 20 with the line 25 purged (no air in line), a vacuum pump 30 with a vacuum hose 32, a digital micron gauge 35, quick connect fittings 40, a custom-made tool/device 50 made to hook up to the AC unit's liquid line to do evacuation and to add 1 oz. of extra refrigerant, and a communication cable 75 that is added to the box. Additionally, wrenches are used to tighten connections, and appropriate tools are needed to open the original AC unit box, remove box staples, and then close and seal the box when finished.

Figure 2:
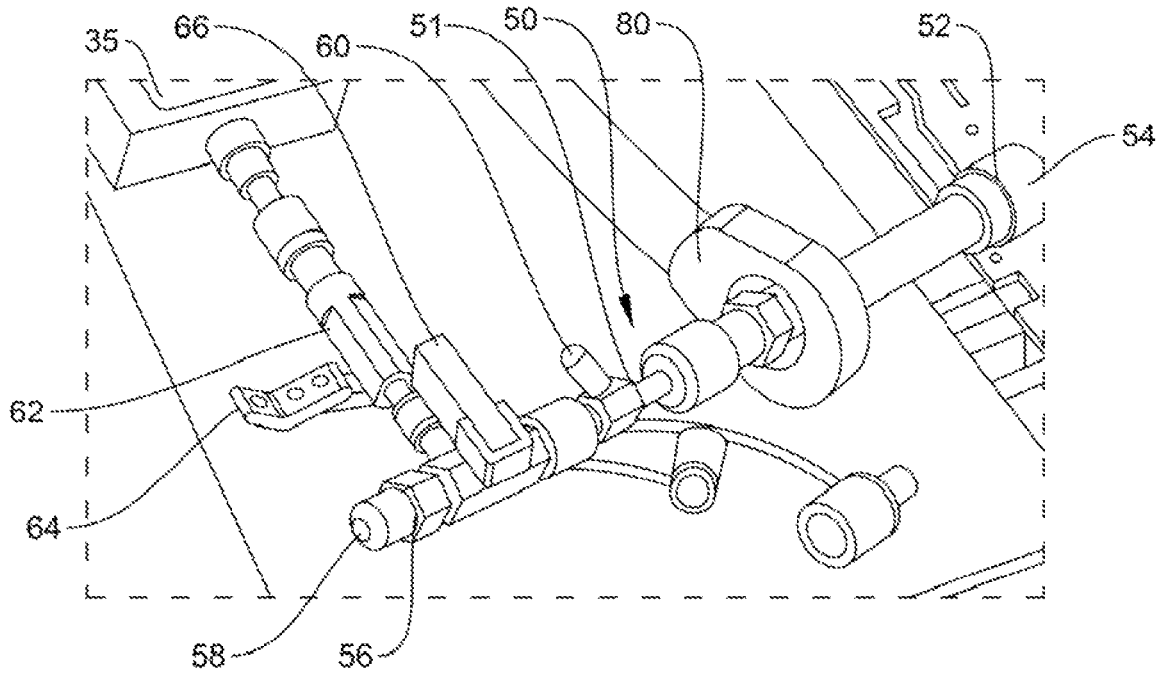
FIG. 2 is an illustration of the fitting tool/device of the present disclosure.
Figure 3:
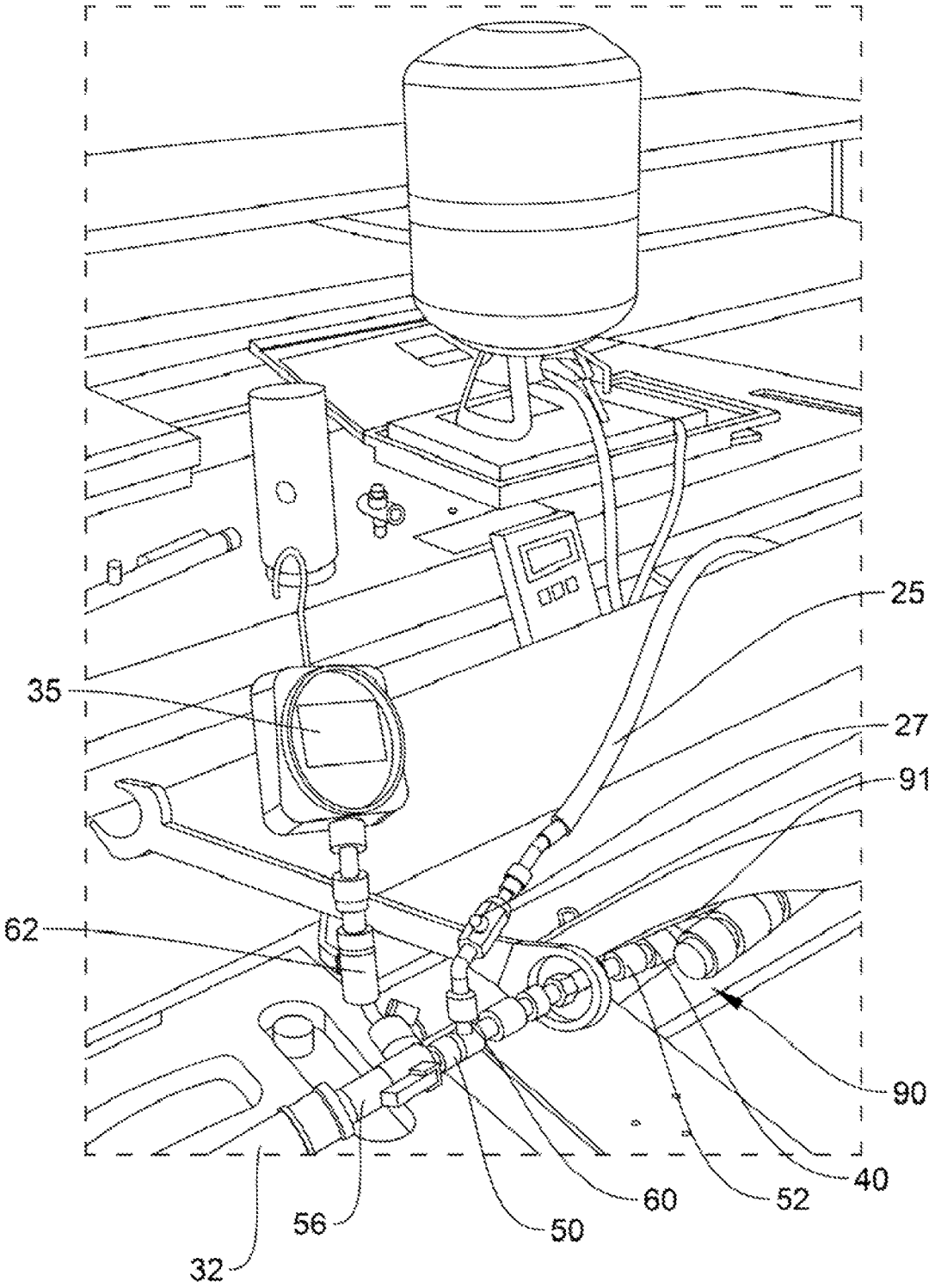
FIG. 3 illustrates the fitting tool/device connected for use in a system of the present disclosure.

FIG. 2 illustrates one embodiment of a fitting tool/device 50. A wrench 80 is used to tighten the fittings and can stay located on the fitting tool/device 50, as shown, to speed up connection to and removal from the AC lines. The fitting tool/device 50 preferably comprises a body portion 51 with a fluid passageway therethrough, a first fitting 52 at a first end 54 to connect to the quick connect fitting 40 which will be placed onto the AC line (see FIG. 11), a second fitting 56 at a second end 58 to connect to the vacuum hose 32, a third fitting 60 to connect to the refrigerant line 25, and a fourth fitting 62 to connect the micron gauge 35. A first valve 64 operatively connected to the fourth fitting 62 is provided to isolate the micron gauge 35. A second valve 66 operatively connected to the second fitting 56 is provided to isolate the vacuum line 32. In this embodiment, the refrigerant line 25 and the vacuum line 32 have their own fittings, fittings 60 and 56 respectively, and can be connected at the same time, as shown in FIG. 3. The refrigerant line 25 also has its own a valve 27.

FIG. 3 illustrates the fitting tool/device 50 in use, connected at fitting 52 to the quick connect fitting 40 attached to one of the AC unit's lines 90, i.e., liquid line 91, the end of which can be seen exposed from in the box 95, and also having the vacuum line 32 connected at fitting 56, the refrigerant line 25 connected at fitting 60, and the micron gauge 35 connected at fitting 62, all connected simultaneously.

Figure 4:
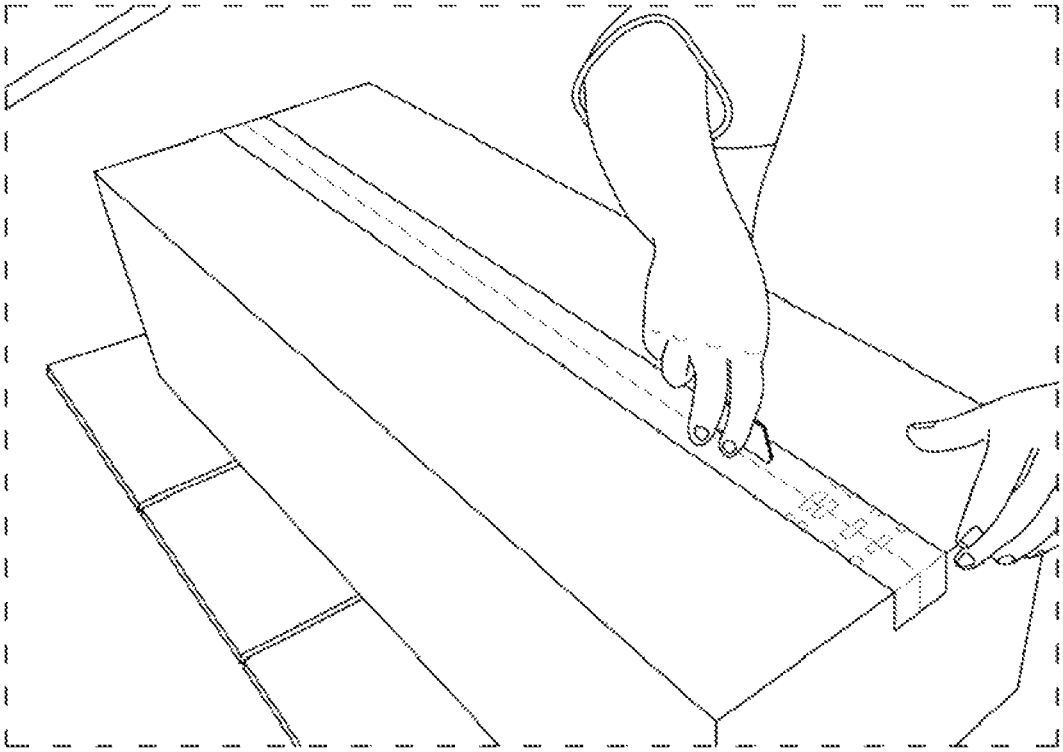
FIG. 4 illustrates one step of a method of an embodiment of the present disclosure.

FIG. 4 illustrates one step of a method of an embodiment of the present disclosure. First the original packaged AC unit box 95 is carefully opened by cutting the packaging tape with a suitable tool such as a utility knife.

Figure 5:
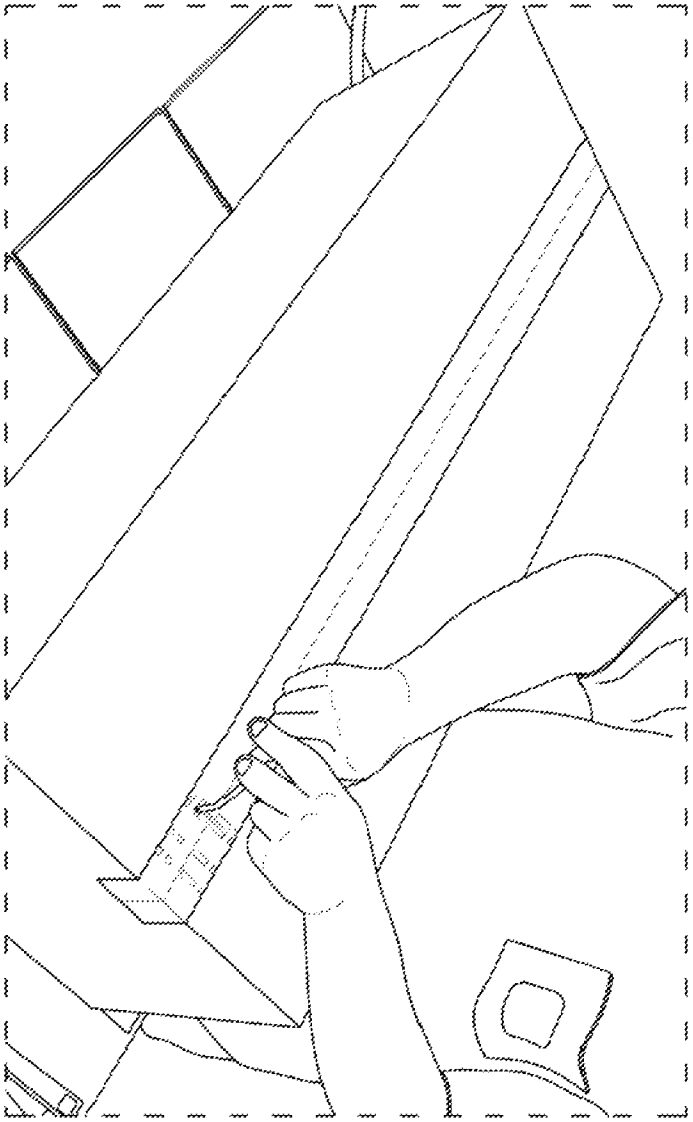
FIG. 5 illustrates another step of a method of an embodiment of the present disclosure.

FIG. 5 illustrates another step of a method of an embodiment of the present disclosure. In this step, any box staples are carefully removed with a suitable tool such as a screwdriver or staple remover. Ordinarily, the AC unit lines 90 will be near the bottom of the box, so the bottom of the box should be opened, not the top.

Figure 6:
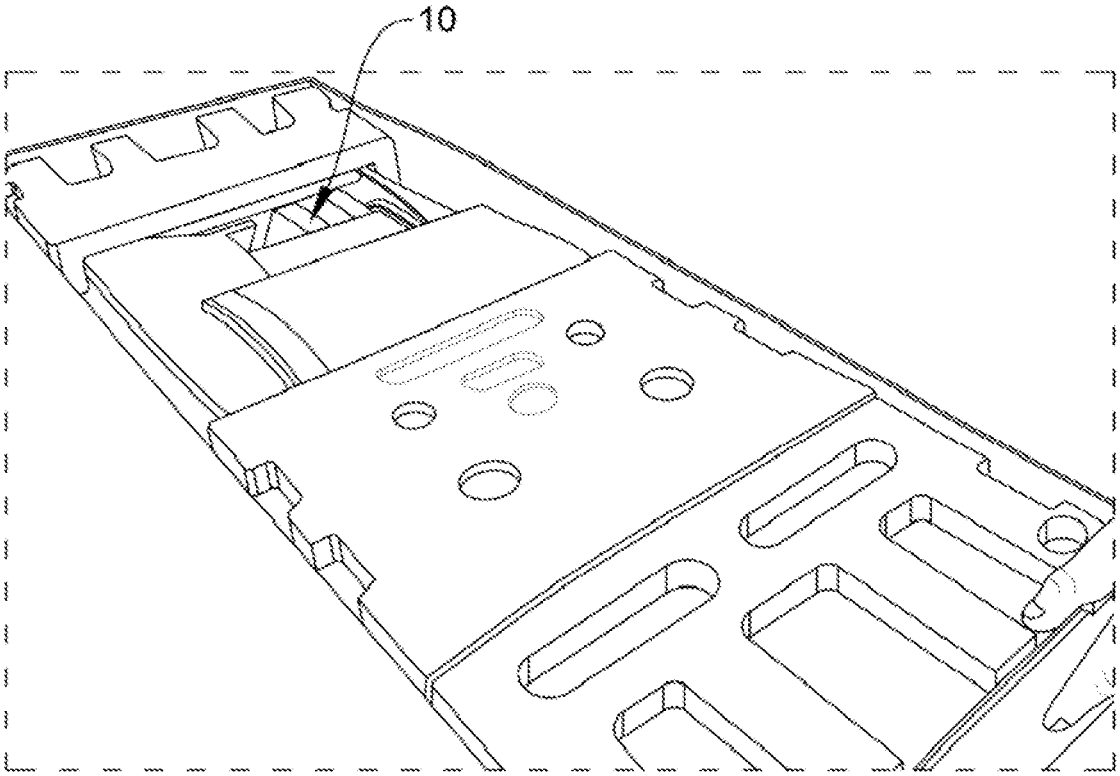
FIG. 6 illustrates another step of a method of an embodiment of the present disclosure.

FIG. 6 illustrates another step of a method of an embodiment of the present disclosure. In this step, the contents of the box 95 are accessed. Remove and set aside any packing material to allow access to the AC unit 10 such as a remote control or instruction/installation manual.

Figure 7:
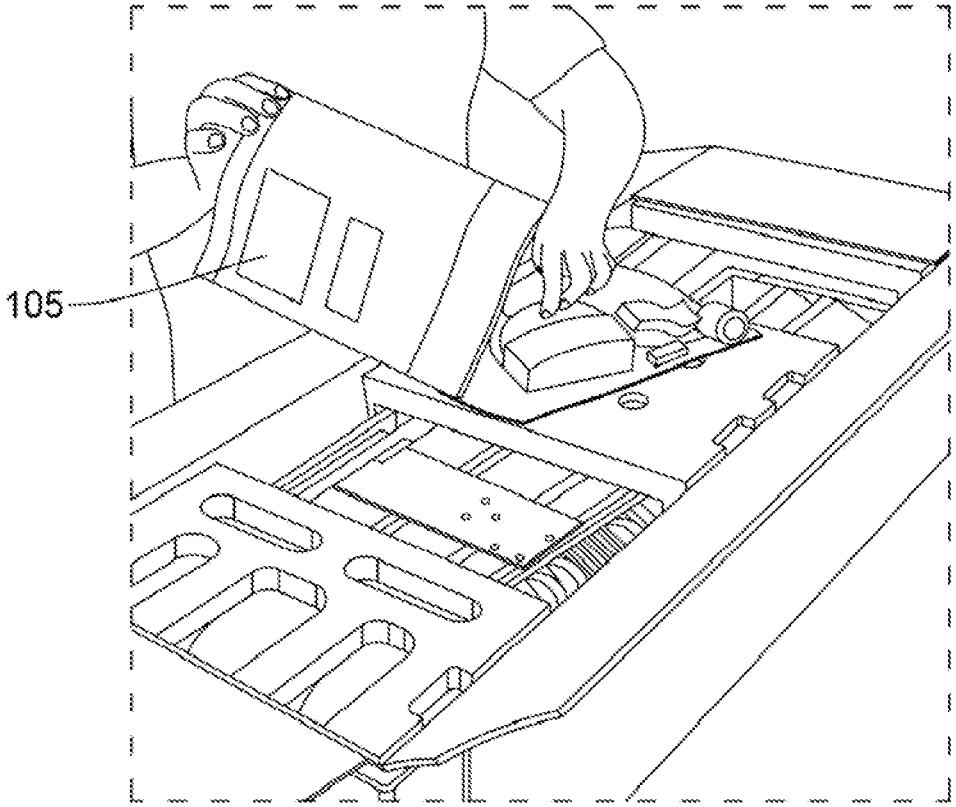
FIG. 7 illustrates another step of a method of an embodiment of the present disclosure.

FIG. 7 illustrates another step of a method of an embodiment of the present disclosure. In this step, the user will remove the instruction/installation manual in the box, and replace with a new instruction/installation manual 105 to reflect and/or address the new quick connect lines.

Figure 8:
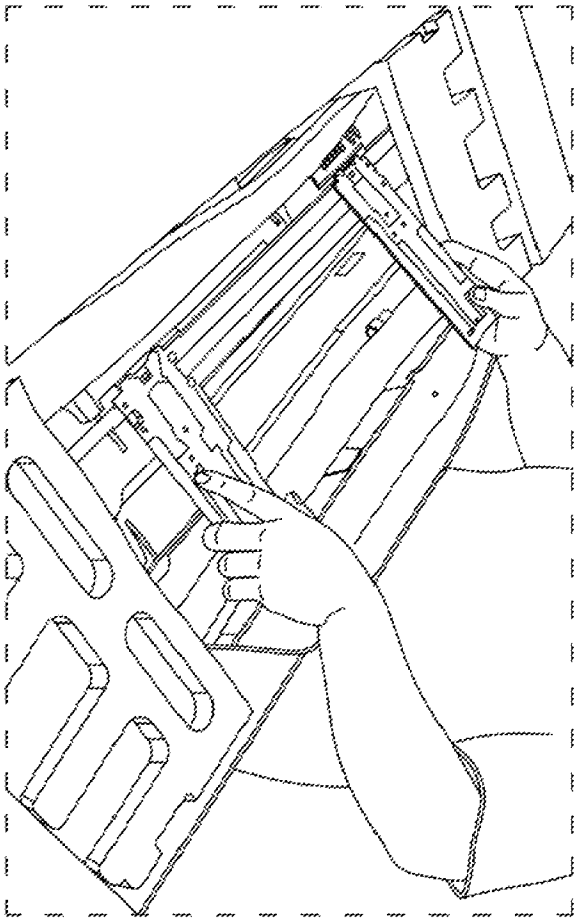
FIG. 8 illustrates another step of a method of an embodiment of the present disclosure.

FIG. 8 illustrates another step of a method of an embodiment of the present disclosure. In this step, if necessary, to gain access to the lines, the user will remove and set aside or reposition any other objects such as brackets to allow access to the lines 90.

Figure 9:
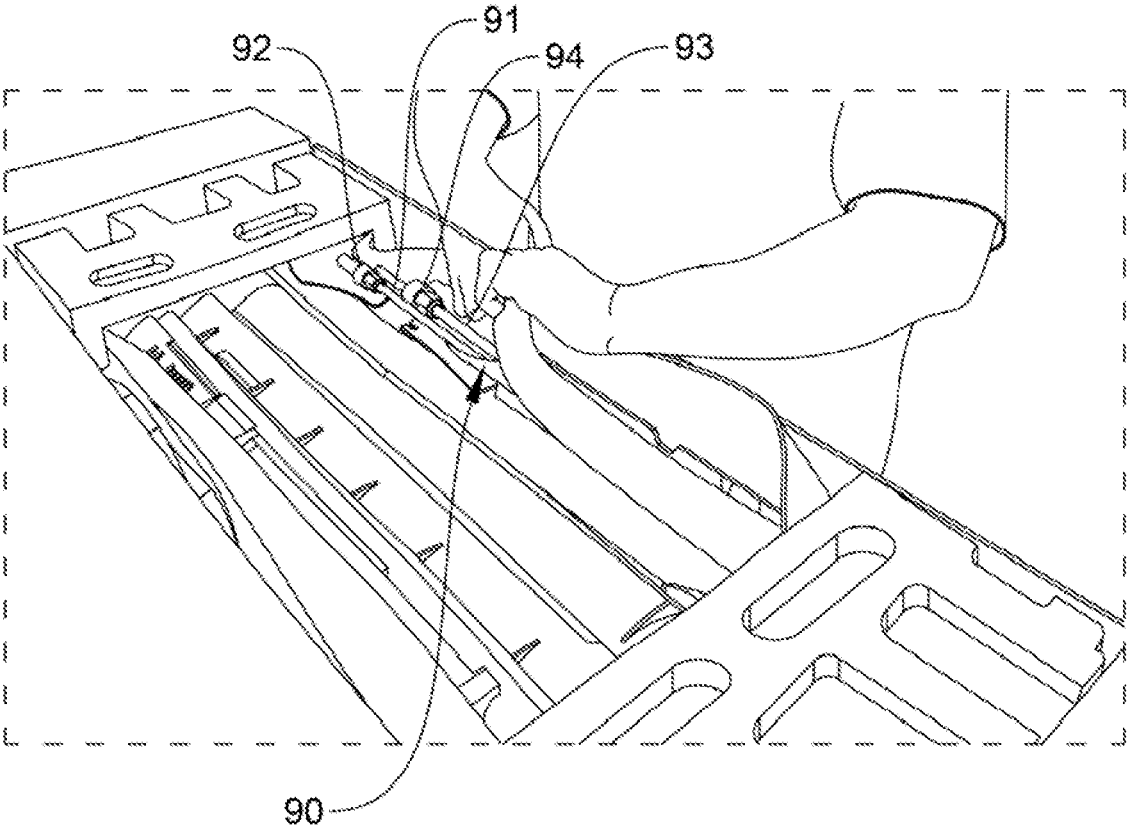
FIG. 9 illustrates another step of a method of an embodiment of the present disclosure.

FIG. 9 illustrates another step of a method of an embodiment of the present disclosure. In this step, the user will access/expose the ends on the lines 90 to be converted to quick connect lines, i.e., liquid line 91 having plastic cap 92, and suction line 93 having plastic cap 94.

Figure 10:
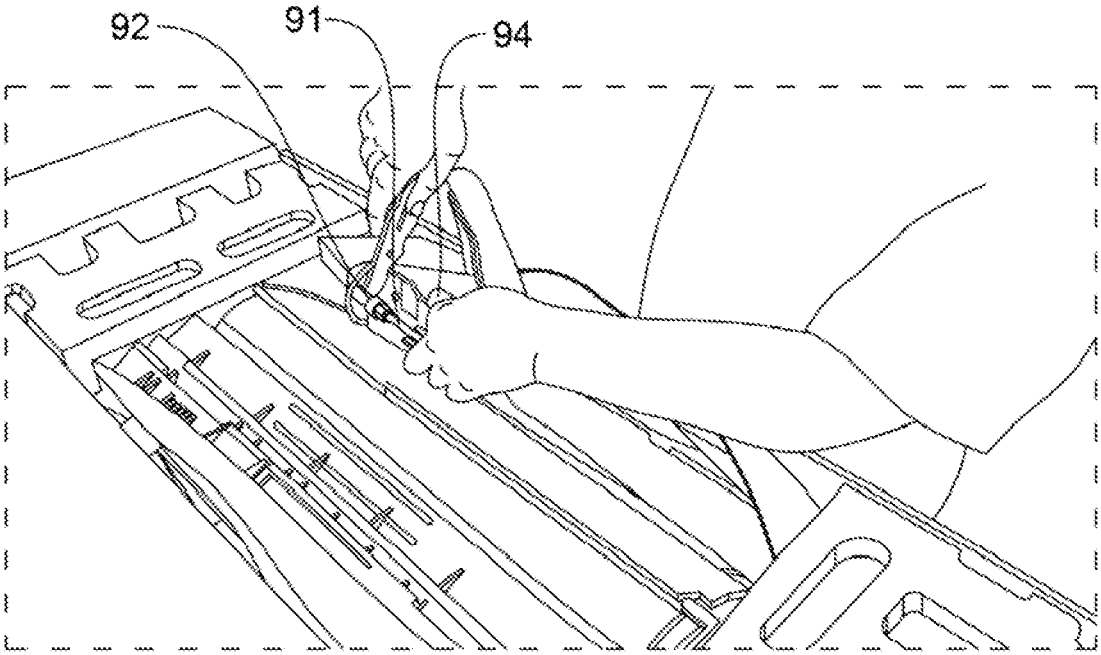
FIG. 10 illustrates another step of a method of an embodiment of the present disclosure.

FIG. 10 illustrates another step of a method of an embodiment of the present disclosure. In this step, the user will release the nitrogen pre-charge that is in the evaporator by loosening and removing the plastic cap 92 on the liquid line 91, then remove the plastic cap 94 from the suction line 93.

Figure 11:
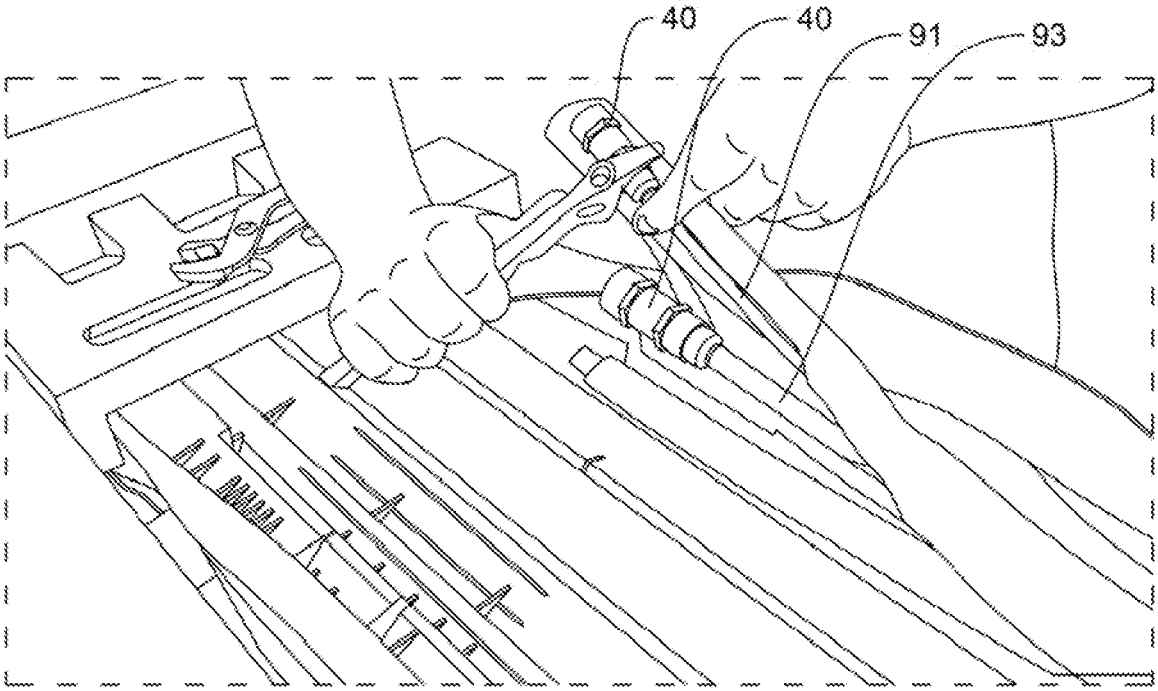
FIG. 11 illustrates another step of a method of an embodiment of the present disclosure.

FIG. 11 illustrates another step of a method of an embodiment of the present disclosure. In this step, the user will screw one "quick connect" fitting 40 on to the suction line 93 and one onto the liquid line 91, and tighten until they cannot be tightened any more.

FIGS. 12-18 illustrate an alternate embodiment of the fitting tool/device 50 than that shown in the preferred embodiment of FIG. 2. The fitting tool/device 50 shown in FIG. 2 has an additional fitting for the refrigerant line, as well as a valve for the micron gauge which allows the micron gauge to stay connected.

Figure 12:
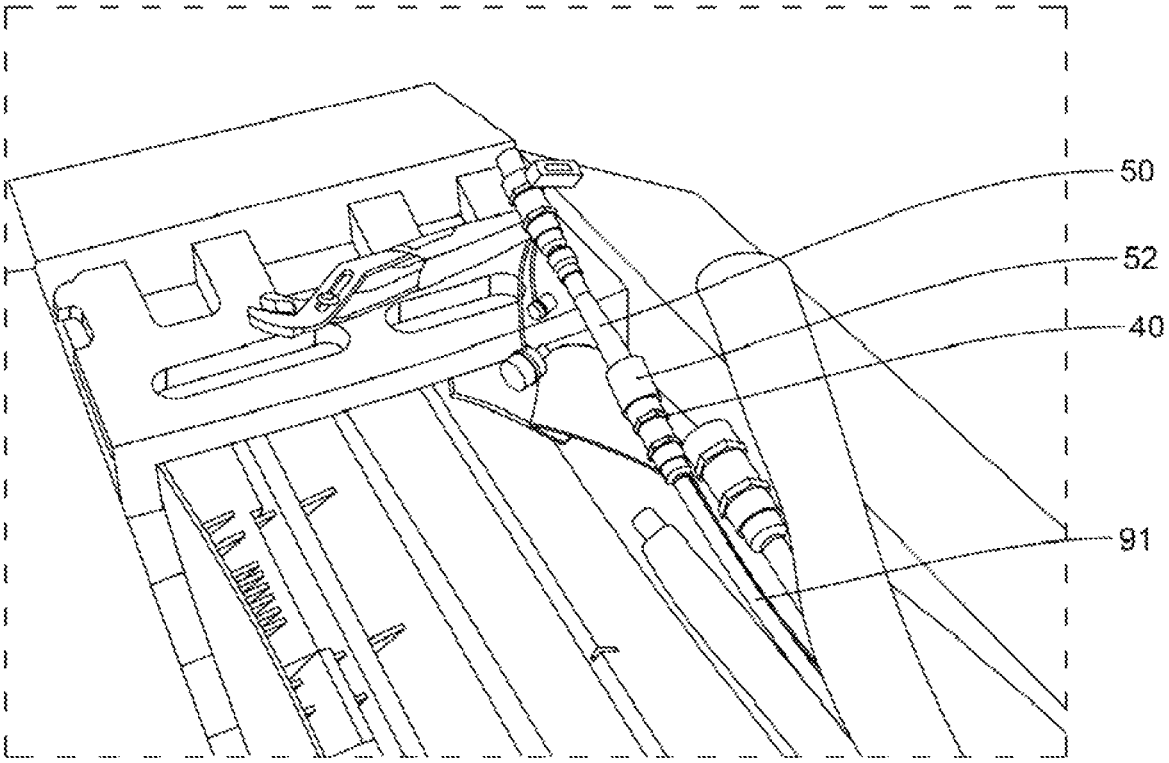
FIG. 12 illustrates another step of a method of an embodiment of the present disclosure.

FIG. 12 illustrates another step of a method of an embodiment of the present disclosure. In this step, the user will screw the first fitting 52 of the fitting tool/device 50 to the quick connect fitting 40 that is on the liquid line 91 of the evaporator and start the evacuation process. The user should make sure the connection is snug.

Figure 13:
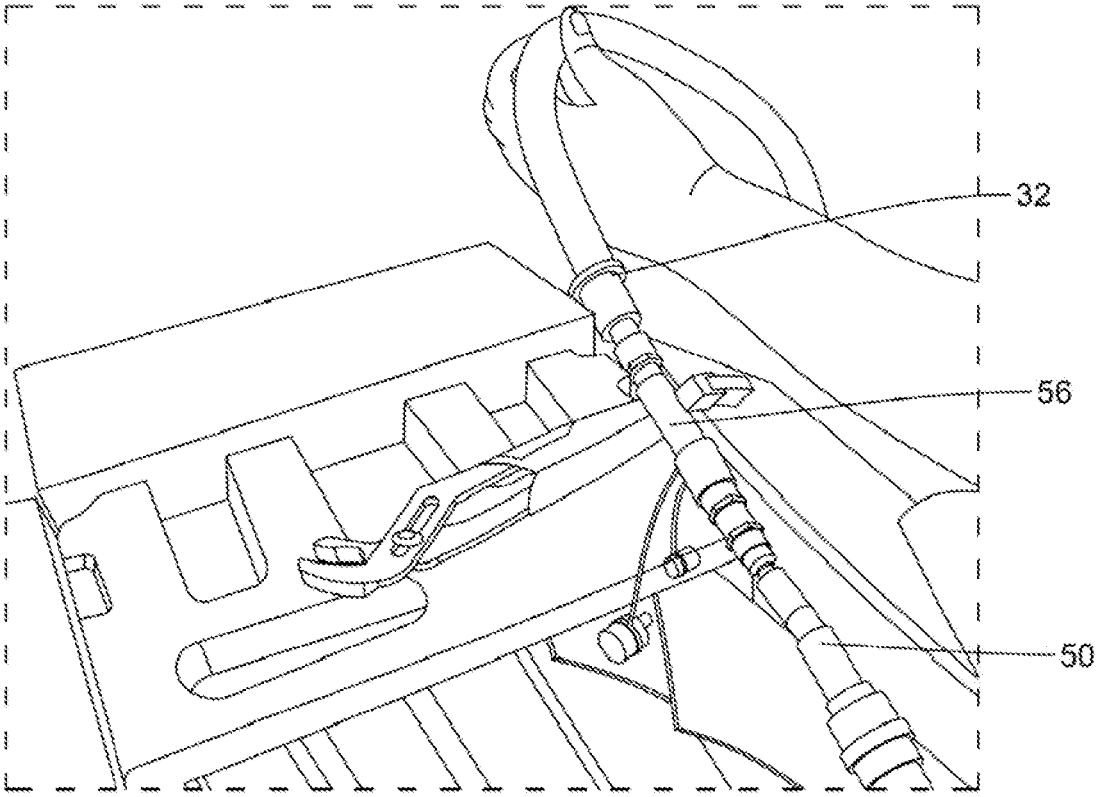
FIG. 13 illustrates another step of a method of an embodiment of the present disclosure.

FIG. 13 illustrates another step of a method of an embodiment of the present disclosure. In this step, the user will connect a vacuum pump line or hose 32 to the second fitting 56 of the fitting tool/device 50.

Figure 14:
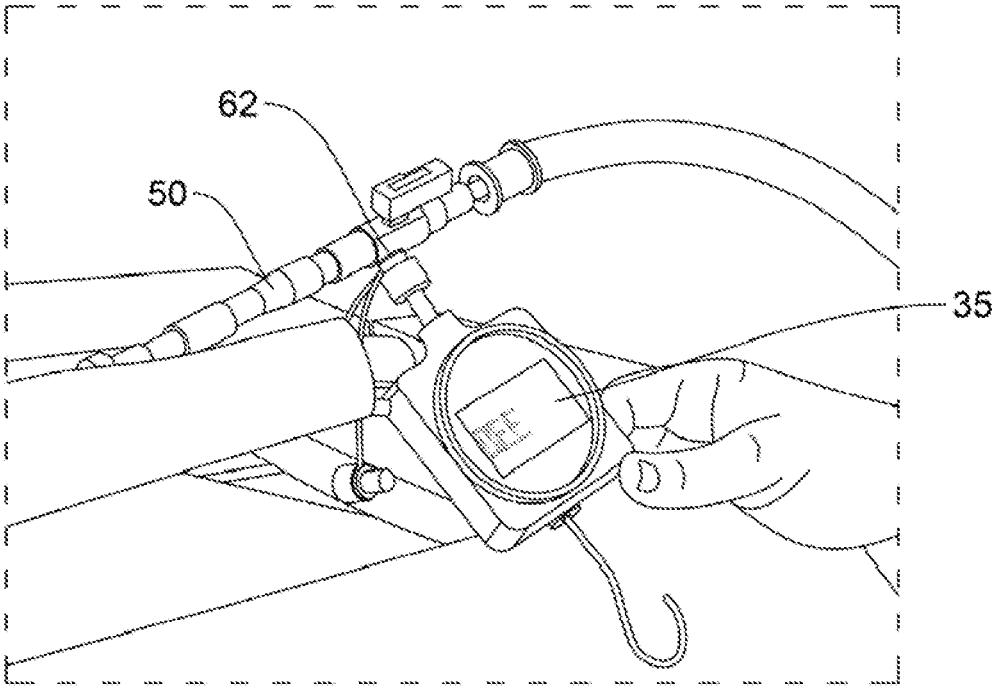
FIG. 14 illustrates another step of a method of an embodiment of the present disclosure.

FIG. 14 illustrates another step of a method of an embodiment of the present disclosure. In this step, the user will connect the micron gauge 35 to fourth fitting 62 of the fitting tool/device 50. Then the user will vacuum the evaporator down to 200 microns on the micron gauge that is connected to the fitting tool/device 50. This can take anywhere from 2 to over 5 minutes depending on the humidity level of the atmosphere where the method is being performed.

Figure 15:
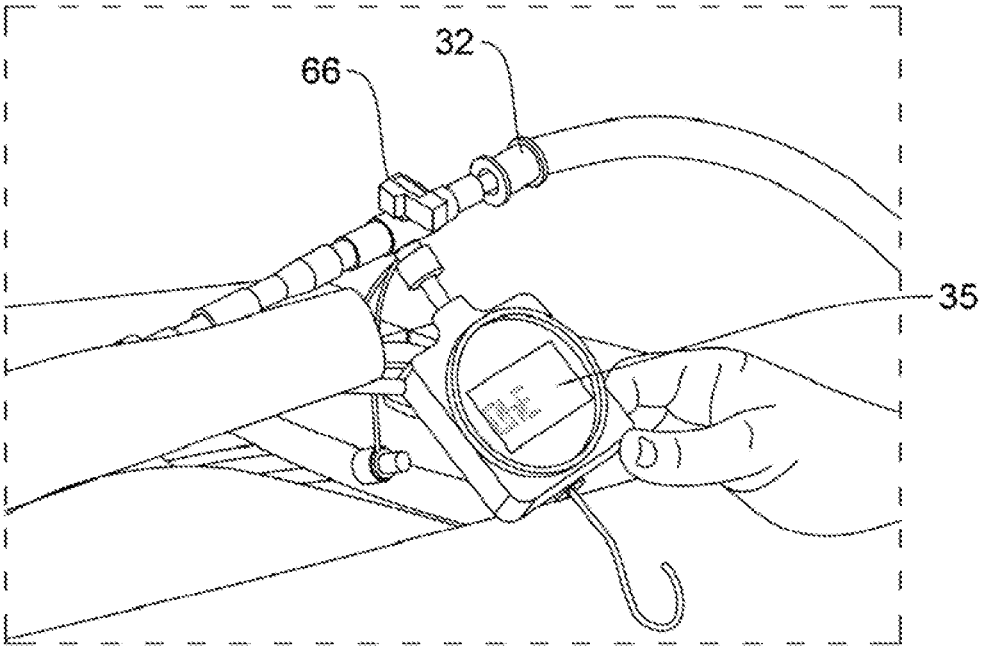
FIG. 15 illustrates another step of a method of an embodiment of the present disclosure.

FIG. 15 illustrates another step of a method of an embodiment of the present disclosure. In this step, the user will isolate the vacuum hose 32 via the second valve 66 and check the reading on the micron gauge 35. If reading goes over 500 microns, reopen valve 66 and run the vacuum longer. The goal is to get as much moisture out of the lines as possible. When the reading stays below 500 microns, the user will take off vacuum pump hose 32. Next, the user should be sure to isolate the micron gauge 35 either with valve 64, or by removing it from the tool/device 50 if valve 64 is not provided, so no refrigerant can/will damage it during the below step of adding refrigerant.

Figure 16:
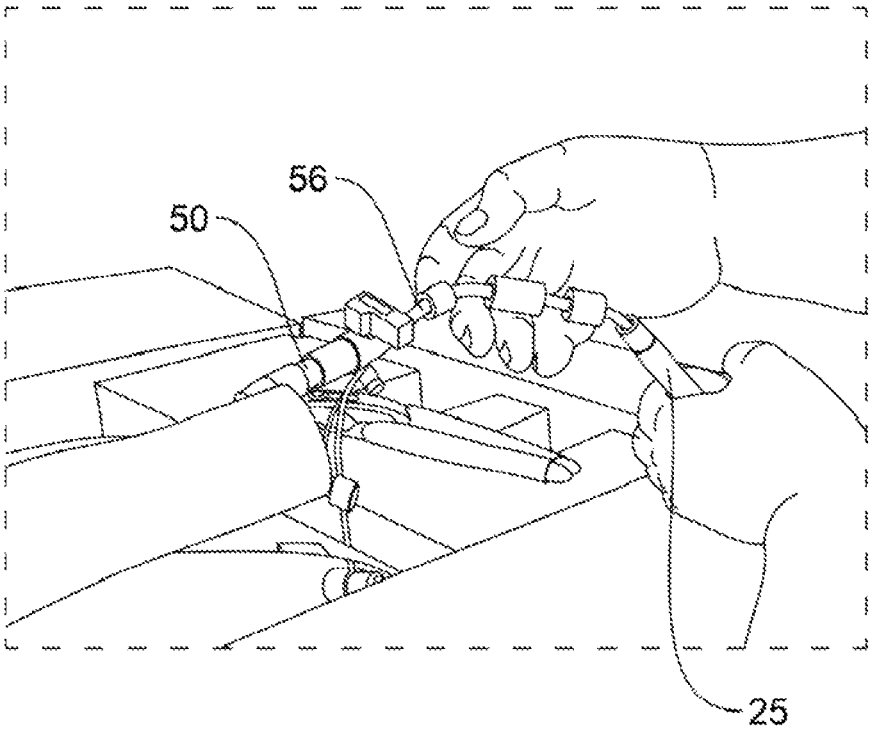
FIG. 16 illustrates another step of a method of an embodiment of the present disclosure.

FIG. 16 illustrates another step of a method of an embodiment of the present disclosure. In this step, the user will connect the refrigerant line 25 that has been purged from air, and is full of refrigerant, to the fitting tool/device 50. FIG. 16 shows the refrigerant line 25 connected at second fitting 56. However, if the third fitting 60 (FIG. 2) is provided, the refrigerant line can be connect to the third fitting 60.

Figure 17:
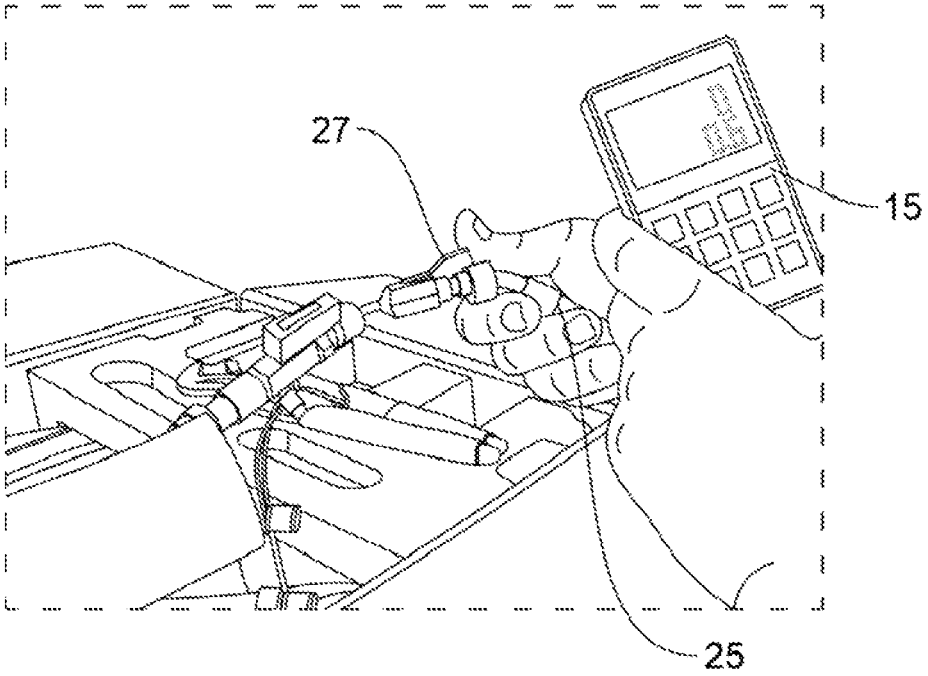
FIG. 17 illustrates another step of a method of an embodiment of the present disclosure.

FIG. 17 illustrates another step of a method of an embodiment of the present disclosure. In this step, the user will open the valve 27 on the refrigerant line 25 to add a quick "shot" of refrigerant. The user will add approximately 1 oz of refrigerant. A wireless scale 15 can be used to measure the amount of refrigerant added.

Figure 18:
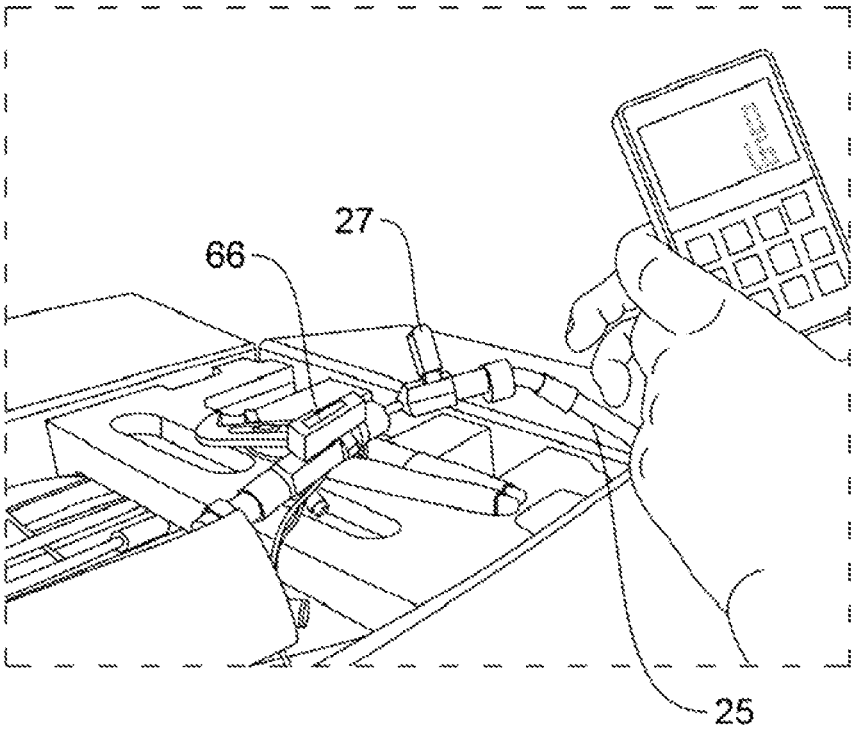
FIG. 18 illustrates another step of a method of an embodiment of the present disclosure.

FIG. 18 illustrates another step of a method of an embodiment of the present disclosure. In this step, once the desired amount of refrigerant is added, the user will close valve 27, and close valve 66 on fitting tool/device 50, and then remove refrigerant line 25.

Figure 19:
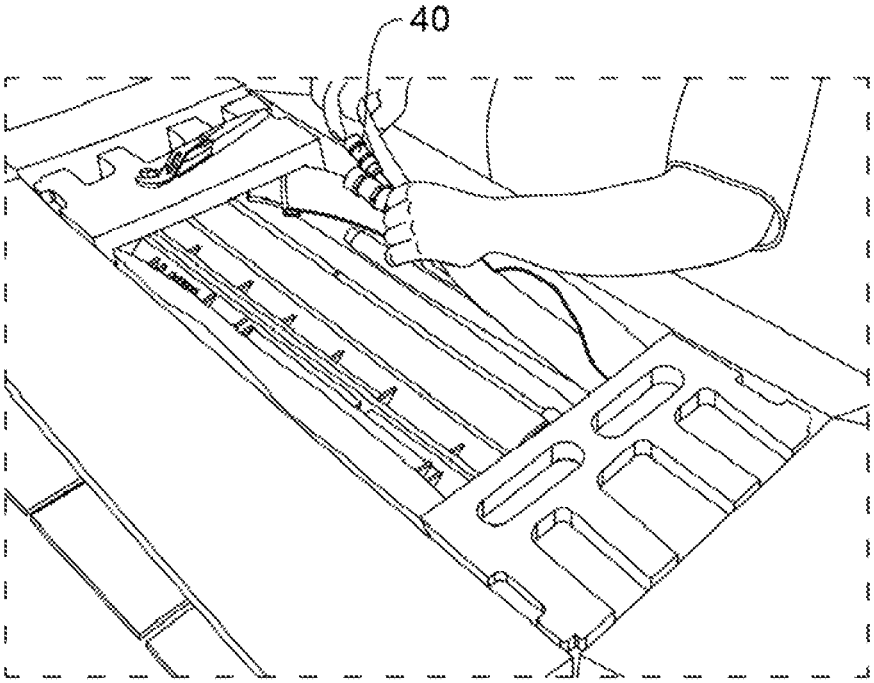
FIG. 19 illustrates another step of a method of an embodiment of the present disclosure.

FIG. 19 illustrates another step of a method of an embodiment of the present disclosure. In this step, the user will remove the fitting tool/device 50 as fast as possible so as not to lose refrigerant, and put the cap back on the quick connect end 40.

Figure 20:
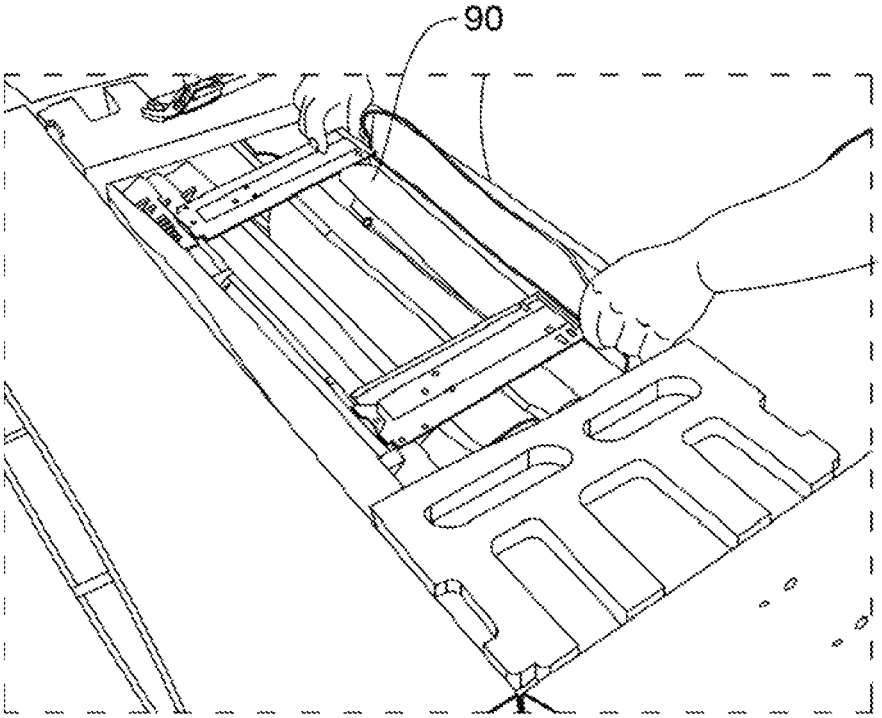
FIG. 20 illustrates another step of a method of an embodiment of the present disclosure.

FIG. 20 illustrates another step of a method of an embodiment of the present disclosure. In this step, the user will put the AC lines 90 back to their original location in the box, and replace any brackets, packing materials, inserts that were removed from the box.

Figure 21:
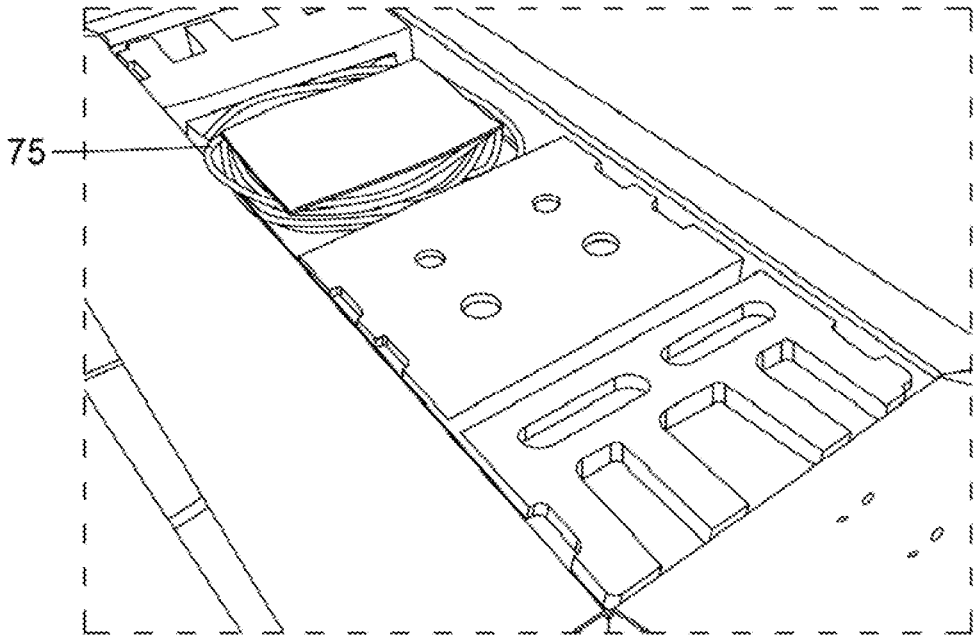
FIG. 21 illustrates another step of a method of an embodiment of the present disclosure.

FIG. 21 illustrates another step of a method of an embodiment of the present disclosure. In this step, the user will add/put the communication line 75 into the box.

Figure 22:
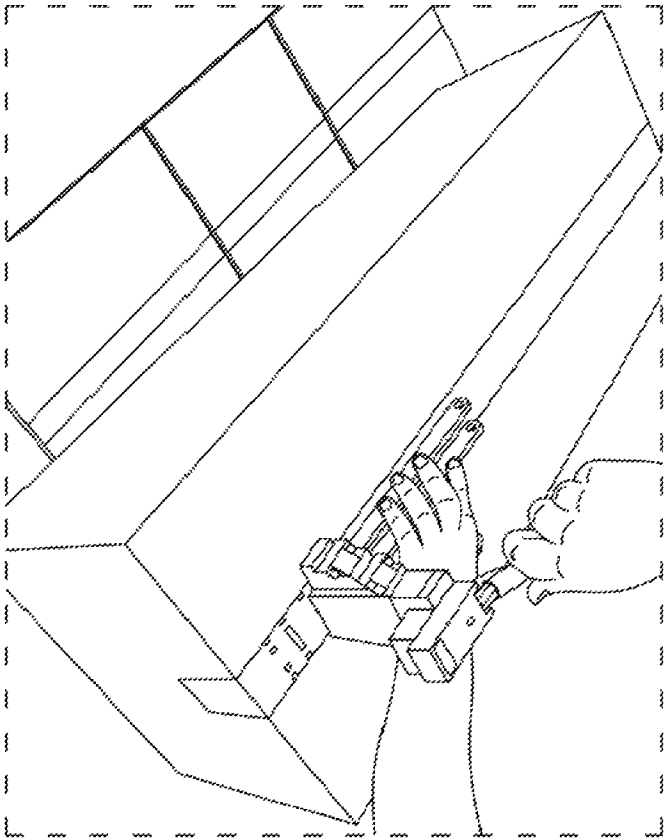
FIG. 22 illustrates another step of a method of an embodiment of the present disclosure.

FIG. 22 illustrates another step of a method of an embodiment of the present disclosure. In this step, the user will close the box 95 and secure shut, for example by re-stapling the box shut.

Figure 23:
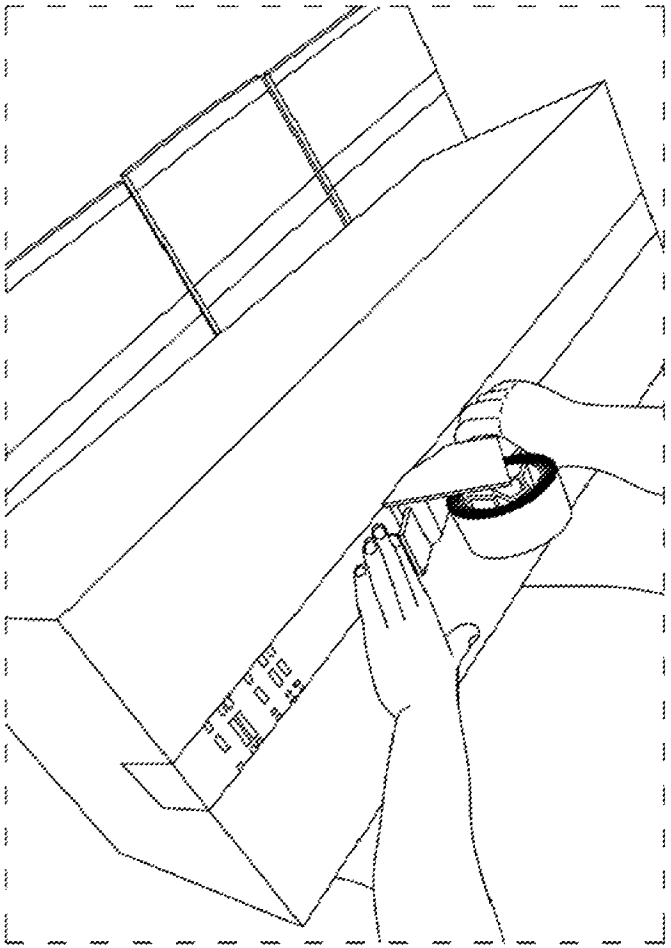
FIG. 23 illustrates another step of a method of an embodiment of the present disclosure.

FIG. 23 illustrates another step of a method of an embodiment of the present disclosure. In this step, the user will reseal the box 95 with packing tape.

Figure 24:
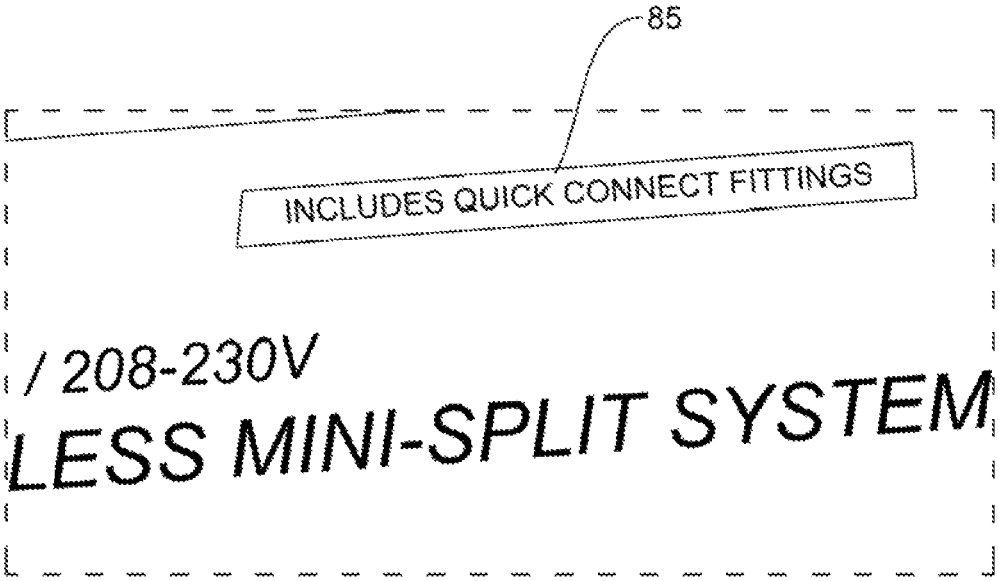
FIG. 24 illustrates another step of a method of an embodiment of the present disclosure.

FIG. 24 illustrates another step of a method of an embodiment of the present disclosure. Finally, in this step, the user will place a label 85 on the box to indicate the AC unit includes the newly added quick connect fittings.

In the manner described above, a pre-packaged AC unit has been converted to an AC unit with quick connect pre-charged ends. It should be understood that some of the steps described herein may be taken at different times in the process. For example, the labels can be placed on the box before, during or after the quick connect lines are completed.

It is to be understood that the teachings herein can be modified for other presently known or future configurations according to the various embodiments described herein.

While the present invention has been described in terms of particular embodiments and applications, in both summarized and detailed forms, it is not intended that these descriptions in any way limit its scope to any such embodiments and applications, and it will be understood that many substitutions, changes and variations in the described embodiments, applications and details of the method, system and device illustrated herein and of their operation can be made by those skilled in the art, without departing from the spirit of this invention.

While the embodiment(s) disclosed herein are illustrative of the structure, function and operation of the exemplary method(s), system(s), component(s) and device(s), it should be understood that various modifications may be made thereto with departing from the teachings herein. Further, the components of the method(s), system(s), component(s) and device(s) disclosed herein can take any suitable form, including any suitable components capable of adequately performing their respective intended functions, as may be known in the art.

While the foregoing discussion presents the teachings in an exemplary fashion with respect to the disclosed method (s), system(s), component(s) and device(s) for mini-split AC units, it will be apparent to those skilled in the art that the present disclosure may be apply to other method(s), system (s) and device(s) that may benefit from the use of quick connect fittings and/or that have standard refrigerant lines. Further, while the foregoing has described what are considered to be the best mode and/or other examples, it is understood that various modifications may be made therein and that the subject matter disclosed herein may be implemented in various forms and examples, and that the method (s), system(s), component(s) and device(s) may be applied in numerous applications, only some of which have been described herein.

The terminology used herein is for the purpose of describing particular environments only and is not intended to be limiting of the method(s), system(s) and device(s). As used herein the term "and/or" includes any and all combinations of one or more of the associated listed items. As used herein the singular forms 'a' 'an' 'and' and 'the' are intended to include the plural forms as well as the singular forms unless the context clearly indicates otherwise. It will be further understood that the terms "comprises" and/or "comprising" when used in this specification specify the presents of stated features, steps, operations, elements and/or components but do not conclude the presence or addition of one or more other features, steps, operations, elements, components and/or groups thereof.

Unless otherwise defined, all terms (including technical and scientific terms) used herein have the same meaning as commonly understood by one having ordinary skill in the art to which the invention belongs. It will be further understood that terms such as those defining commonly used dictionary terms, should be interpreted as having a meaning that is consistent with their meaning in the context of the relevant art and the present disclosure and will not be interpreted in an idealized or overly formal sense since expressly so defined herein.

In describing the method(s), system(s) and device(s) herein, it will be understood that a number of techniques and steps are disclosed. Each of these have individual benefits and each can also be used in conjunction with one or more or in some cases all of the other disclosed techniques. Accordingly, for the sake of clarity this description will refrain from repeating every possible combination of the individual steps in an unnecessary fashion. Nevertheless, the specification and claims should be read with the understanding that such combinations are entirely within the scope of the claims. Further, it should be understood that one or more of the steps described herein may be performed in a different sequence than described, or may be omitted, without departing from the spirit and scope of the present disclosure, so long as a standard AC unit can be converted to a quick connect AC unit according to the basic teachings disclosed herein.

What is claimed is:

1. A method for converting an AC unit having an evaporator and two AC lines into a quick connect AC unit, comprising the steps of:

releasing nitrogen from the evaporator;

attaching quick connectors to the AC lines;

attaching a fitting tool/device to one of the quick connectors, wherein the fitting tool/device has at least three fittings;

attaching a vacuum pump and hose to the fitting tool/device;

attaching a refrigerant supply and supply line to the fitting tool/device;

attaching a micron gauge to the fitting tool/device; and vacuuming the evaporator until the micro gauge reads and stays below 500 microns.

2. The method of claim 1, wherein the fitting tool/device has at least four fittings.

3. The method of claim 1, further comprising the step of providing a scale for measuring an amount of refrigerant.

4. The method of claim 1, wherein one of the at least three fittings has a valve.

5. The method of claim 1, wherein two of the at least three fittings have a valve.

6. The method of claim 1, wherein the refrigerant supply line has a valve.

7. The method of claim 1, wherein the fitting tool/device has at least four fittings.

8. A method for converting an AC unit having an evaporator and two AC lines into a quick connect AC unit, comprising the steps of:

releasing nitrogen from the evaporator;

attaching a quick connect fitting onto each of the two AC lines;

attaching a fitting tool/device having at least three fittings onto one of the quick connect fittings via a first of the at least three fittings;

attaching a vacuum pump line to a second of the at least three fittings on the fitting tool/device;

attaching a micron gauge to a third of the at least three fittings on the fitting tool/device;

vacuuming the evaporator until the micro gauge reads and stays below 500 microns.

9. The method of claim 6, further comprising the step of attaching a refrigerant supply line to one of the at least three fittings; and adding refrigerant to the evaporator.

10. The method of claim 9, wherein the AC unit is prepackaged in a container, and wherein the method further comprises replacing an existing instruction manual in the container with a new instruction manual.

11. The method of claim 9, wherein the AC unit is prepackaged in a container, and wherein the method further comprises adding a communication cable to the container.

12. The method of claim 9, wherein the AC unit is prepackaged in a container, and wherein the method further comprises adding a quick connect indication label to the container.

13. The method of claim 8, further comprising the step of providing valves on the second and the third of the at least three fittings on the fitting tool/device.

14. A method for converting an AC unit having an evaporator and two AC lines into a quick connect AC unit, comprising the steps of:

releasing nitrogen from the evaporator;

attaching a quick connect fitting onto each of the two AC lines;

attaching a fitting tool/device having a plurality of fittings onto one of the quick connect fittings;

attaching a vacuum pump line to one of the plurality of fittings on the fitting tool/device;

attaching a micron gauge to one of the plurality of fittings on the fitting tool/device;

vacuuming the evaporator until the micro gauge reads and stays below a threshold micron reading on the micron gauge.

15. The method of claim 14, further comprising the step of attaching a refrigerant supply line to one of the plurality of fittings on the fitting tool/device; and adding refrigerant to the evaporator.

16. The method of claim 15, wherein the AC unit is prepackaged in a container, and wherein the method further comprises replacing an existing instruction manual in the container with a new instruction manual.

17. The method of claim 15, wherein the AC unit is prepackaged in a container, and wherein the method further comprises adding a communication cable to the container.

18. The method of claim 15, wherein the AC unit is prepackaged in a container, and wherein the method further comprises adding a quick connect indication label to the container.

19. The method of claim 15, further comprising the step of providing valves on at least one of the plurality of fittings on the fitting tool/device.

20. The method of claim 14, wherein the plurality of fittings on the fitting tool/device comprises at least three fittings.

* * * * *